US008029339B2

(12) United States Patent
Kato et al.

(10) Patent No.: US 8,029,339 B2
(45) Date of Patent: Oct. 4, 2011

(54) WORKPIECE DOUBLE-DISC GRINDING APPARATUS AND WORKPIECE DOUBLE-DISC GRINDING METHOD

(75) Inventors: Tadahiro Kato, Nishishirakawa (JP); Kenji Kobayashi, Nishishirakawa (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 12/812,959

(22) PCT Filed: Jan. 23, 2009

(86) PCT No.: PCT/JP2009/000247

§ 371 (c)(1),
(2), (4) Date: Jul. 15, 2010

(87) PCT Pub. No.: WO2009/101766

PCT Pub. Date: Aug. 20, 2009

(65) Prior Publication Data

US 2011/0053470 A1 Mar. 3, 2011

(30) Foreign Application Priority Data

Feb. 14, 2008 (JP) ..... 2008-033611

(51) Int. Cl.
*B24B 7/26* (2006.01)

(52) U.S. Cl. ..... 451/267; 451/268; 451/259

(58) Field of Classification Search ..... 451/41, 451/57, 58, 63, 262, 264, 267, 268, 269, 451/402

See application file for complete search history.

(56) References Cited

U.S. PATENT DOCUMENTS

| | | | | |
|---|---|---|---|---|
| 6,652,358 | B1 | 11/2003 | Ikeda et al. | |
| 6,830,505 | B2 * | 12/2004 | Moriya et al. | 451/262 |
| 7,364,495 | B2 * | 4/2008 | Tominaga et al. | 451/41 |
| 2002/0016072 | A1 | 2/2002 | Hashii et al. | |

FOREIGN PATENT DOCUMENTS

| | | |
|---|---|---|
| JP | A-7-32252 | 2/1995 |
| JP | A-2002-124490 | 4/2002 |
| JP | A-2003-124167 | 4/2003 |
| JP | A-2007-96015 | 4/2007 |
| WO | WO 00/67950 | 11/2000 |
| WO | WO 2006/018961 A1 | 2/2006 |

OTHER PUBLICATIONS

Search Report dated Mar. 10, 2009 issued in International Patent Application No. PCT/JP2009/000247 (with translation).

* cited by examiner

*Primary Examiner* — Timothy V Eley
(74) *Attorney, Agent, or Firm* — Oliff & Berridge, PLC

(57) ABSTRACT

A workpiece double-disc grinding apparatus including a holder that supports a thin-plate-like workpiece from an outer periphery along a radial direction and is rotatable; a pair of static pressure support members that support the holder from both sides along an axial direction of the rotation thereof in a contactless manner based on a static fluid pressure; and a pair of grinding stones that simultaneously grind both surfaces of a workpiece supported by the holder, in which an interval between the holder and the static pressure support member is not greater than 50 μm, and the static pressure of the fluid that is not lower than 0.3 MPa. As a result, the workpiece double-disc grinding apparatus and a workpiece double-disc grinding method can stabilize a position of the holder, which can be a cause that degrades a nanotopography of the workpiece in the double-disc grinding for the workpiece.

20 Claims, 11 Drawing Sheets

$$D = e + f + (h - g)/2 + \alpha$$

$D$: INTERVAL BETWEEN WORKPIECE HOLDER AND STATIC PRESSURE MEMBER $e$: FLATNESS OF STATIC PRESSURE MEMBER $f$: PARALLELISM OF WORKPIECE HOLDER $h$-$g$: FLATNESS OF WORKPIECE HOLDER $\alpha$: STATIC PRESSURE WATER FILM THICKNESS

PRIOR ART ( a )

PRIOR ART

WORKPIECE DOUBLE-DISC GRINDING APPARATUS AND WORKPIECE DOUBLE-DISC GRINDING METHOD

TECHNICAL FIELD

The present invention relates to a workpiece double-disc grinding apparatus and a workpiece double-disc grinding method configured to simultaneously grind both surfaces of a thin-plate-like workpiece such as a silicon wafer, and more particularly to a workpiece double-disc grinding apparatus and a workpiece double-disc grinding method configured to support a workpiece holder that supports a workpiece in a contactless manner and grind both surfaces of the workpiece.

BACKGROUND ART

For example, in an advanced device that adopts a silicon wafer having a larger diameter typified by, e.g., a diameter of 300 mm, a magnitude of a surface waviness component called a nanotopography has recently become a problem. The nanotopography is one kind of surface shapes of wafers, indicative of irregularities of a wavelength component of 0.2 to 20 mm in which a wavelength is shorter than that of Sori or Warp but longer than that of surface roughness, and is a very shallow waviness component having a PV value of 0.1 to 0.2%. It is said that this nanotopography affects a yield ratio of an STI (Shallow Trench Isolation) process in a device process, and a rigorous level and fineness of a design rule are demanded with respect to a silicon wafer that becomes a device substrate.

The nanotopography is created in a machining process of a silicon wafer. It is apt to be degraded particularly in a processing method having no reference surface, e.g., wire saw cutting or double-disc grinding, and an improvement or management of relative meandering of a wire in the wire saw cutting or a warp of the wafer in the double-disc grinding is important.

The nanotopography of a silicon wafer after mirror polishing is generally measured by an optical interferometer Nanomapper (manufactured by ADE Corp.) or Dynasearch (manufactured by Raytex Corporation).

FIG. 9 are nanotopography maps measured by Nanomapper and show intensities of nanotopography by shading. FIG. 9(*a*) shows an example of a map that does not have a problem in an intensity level of the nanotopography in particular, and FIG. 9(*b*) shows an example of a bad level created in a double-disc grinding process.

When a workpiece in a process such as a slicing process or double-disc grinding process is a non-mirror workpiece, performing arithmetic bandpass filter processing with respect to a Sori shape obtained from a measuring instrument adopting a capacitance system enables measuring a nanotopography in a simplified manner as disclosed in International Publication No. 2006/018961.

FIG. 10(*a*) shows an example of a pseudo-nanotopography obtained by performing bandpass filter processing of 50 mm to 1 mm with respect to a Sori shape of a double-disc ground wafer measured by a measuring instrument adopting the capacitance system. It is to be noted that FIG. 10(*b*) is a graph showing a nanotopography when measured by Nanomapper.

To satisfy conditions under which a nanotopography level having a wavelength size of 10 mm is not greater than 15 nm in a final product, which is becoming a mainstream as a recent demand, a pseudo-nanotopography must be equal to or below 0.2 μm in an intermediate process.

FIG. 12 shows a relationship between a value of a pseudo-nanotopography after the double-disc grinding process and a value of a nanotopography after a final process. It can be understood that they have a good correlation.

A conventional double-disc grinding method will now be described.

First, FIG. 8 shows an example of a conventional workpiece double-disc grinding apparatus that is used for double-disc grinding. As shown in FIG. 8, a double-disc grinding apparatus 101 includes a workpiece holder 102 that supports a workpiece W having a thin plate-like shape from an outer peripheral side along a radial direction and can rotate, a pair of static pressure support members 103 that are positioned on both sides of the workpiece holder 102 and support the workpiece holder 102 from both sides along an axial direction of the rotation in a contactless manner by using a static pressure of a fluid, and a pair of grinding stones 104 that simultaneously grind both surfaces of the workpiece W supported by the workpiece holder 102. The grinding stones 104 are disposed to a motor 105 and can rotate at a high speed.

When such a double-disc grinding apparatus 101 is utilized to grind both surfaces of the workpiece W, the workpiece W is first supported by the workpiece holder 102. It is to be noted that rotating the workpiece holder 102 enables rotating the workpiece W. Further, a fluid is supplied to a space between the workpiece holder 102 and the static pressure support members 103 from the respective static pressure support members 103 on both sides to support the workpiece holder 102 along the axial direction of the rotation by using a static pressure of the fluid. Furthermore, both the surfaces of the workpiece W that is supported by the workpiece holder 102 and the static pressure support members 103 and rotates are ground by using the grinding stones 104 rotating at a high speed by the motor 105.

Various improvements of means for supporting a workpiece in a rotation axis direction have been conventionally examined since a damage of the workpiece produced during grinding affects an accuracy or a nanotopography of a processing target surface.

For example, International Publication No. 2000/67950 suggests performing grinding while controlling a relative position of the center of a thickness of a workpiece and/or the center of supporting means for supporting the workpiece and the center of an interval between grinding stone surfaces of a pair of grinding stones for grinding.

Moreover, for example, in such an apparatus adopting a static pressure support using a fluid as depicted in FIG. 8, Japanese Unexamined Patent Publication (Kokai) No. 2007-96015 discloses that a nanotopography component that cannot be sufficiently improved by an adjustment function provided in the conventional apparatus, i.e., tilt adjustment or shift adjustment of a grinding stone axis can be improved by adopting a static pressure supply member in which each of a plurality of pockets has support holes for a fluid and which can adjust a static pressure of the fluid in accordance with each pocket with respect to a static pressure support method for front and back surfaces that support a workpiece in an axial direction.

As described above, in the conventional technology, preventing the workpiece from being deformed as much as possible during grinding is important in the light of the nanotopography, and energy has been contributed to tilt control or shift control over the grinding stone axis or control over a static pressure that supports a workpiece at an adequate position in the rotation axis direction.

However, when such a conventional double-disc grinding apparatus or double-disc grinding method is utilized to measure a pseudo-nanotopography of a wafer subjected to double-disc grinding, there are many irregularities, and a nanotopography level having a wavelength size of 10 mm exceeds 0.2 μm in some cases. When the pseudo-nanotopography in the double-disc grinding process exceeds 0.2 μm in this manner, a nanotopography level exceeds 15 nm in a final product, and suppressing the nanotopography to a level that has been recently demanded is difficult (FIG. 12).

DISCLOSURE OF INVENTION

It has been conventionally considered that a workpiece holder that supports a workpiece from an outer peripheral side along a radial direction and rotates the same does not affect a wafer quality, e.g., a nanotopography in the double-disc grinding apparatus. However, as a result of conducting an investigation about problems in such double-disc grinding, the present inventors have revealed that importance lies in control over a position along an axial direction of rotation of a workpiece holder as supporting means along a radial direction of the workpiece rather than tilt control or shift control over the grinding stone axis or control over a static pressure for supporting the workpiece at an adequate position in the axial direction of the rotation in regard to control over the nanotopography.

It is, therefore, an object of the present invention is to provide a double-disc grinding apparatus and a double-disc grinding method that can stabilize a position along an axial direction of rotation of a workpiece holder that supports a workpiece from an outer peripheral side, which may be a factor that degrades a nanotopography of the workpiece, in double-disc grinding for the workpiece.

To achieve this object, according to the present invention, there is provided a workpiece double-disc grinding apparatus comprising at least: a workpiece holder that supports a thin-plate-like workpiece from an outer peripheral side along a radial direction and is able to rotate; a pair of static pressure support members that are positioned on both sides of the workpiece holder and support the workpiece holder from both sides along an axial direction of the rotation thereof in a contactless manner based on a static pressure of a fluid; and a pair of grinding stones that simultaneously grind both surfaces of a workpiece supported by the workpiece holder, wherein an interval between the workpiece holder and the static pressure support member is not greater than 50 μm, and the static pressure support members support the workpiece holder based on the static pressure of the fluid that is not lower than 0.3 MPa.

In conventional examples, an influence of a position of the workpiece holder along the axial direction of the rotation thereof that adversely affects the nanotopography of the workpiece has not been found, and a value of, e.g., 200 to 500 μm is general as the interval between the workpiece holder and the static pressure support member.

However, like the present invention, if the double-disc grinding apparatus in which the interval between the workpiece holder and the static pressure support member, i.e., the interval between a surface of the workpiece holder that is supported in a contactless manner and a surface of each static pressure support member that supports the workpiece holder in a contactless manner is not greater than 50 μm and the static pressure support members support the workpiece holder with a static pressure of a fluid that is not lower than 0.3 MPa is adopted, a position of the workpiece holder that supports the workpiece can be stabilized when effecting double-disc grinding, and the nanotopography of the workpiece can be considerably suppressed from being degraded due to this stabilization.

At this time, it is preferable that the workpiece holder has parallelism of 5 μm or below and flatness of 5 μm or below.

When the interval between the workpiece holder and the static pressure support member is narrowed to not greater than 50 μm like the present invention, a load is apt to be applied when rotating the workpiece holder and the workpiece held by the workpiece holder. However, if the parallelism is 5 μm or below and the flatness is 5 μm or below as shape accuracies of the workpiece holder, the load can be sufficiently suppressed, thereby further smoothly effecting the double-disc grinding.

It is to be noted that the parallelism of the workpiece holder used herein means a deviation amount of each of flat front and back surfaces from an appropriate position and the flatness means a PV value of waviness of this surface.

In this case, it is preferable that at least a surface of the workpiece holder that is supported in the contactless manner is formed of alumina ceramics.

If the alumina ceramics is used, workability is excellent, thermal expansion hardly occurs even though heat is generated during processing, and the shape accuracies of the surface of the workpiece holder that is supported in a contactless manner can be increased.

Moreover, it is preferable that a surface of the static pressure support member that supports the workpiece holder in the contactless manner has flatness of 20 μm or below.

When such a configuration is adopted, a load is hard to be applied at the time of rotating the workpiece holder even though the interval between the workpiece holder and the static pressure support member is narrowed to not greater than 50 μm like the present invention, thus more smoothly effecting double-disc grinding.

Additionally, the grinding stone can be formed of diamond abrasive grains having an average grain size of 1 μm or below and a vitrified bond material.

In recent years, not only achieving a quality of a workpiece but also reducing a manufacturing cost have been desired because of demands from customers, a reduction in basic units of raw materials that is attained by a decrease in a processing amount of each process or an improvement in productivity of a processing apparatus is required to reduce the manufacturing cost. In the double-disc grinding process, a great technical problem is to reduce a polishing amount in a double-side polishing process as a post-process by fining a diamond abrasive grain of the grinding stones for grinding. Although a grinding stone having a size #3000 and an average abrasive grain size of 4 μm is utilized in conventional examples, development of a grinding stone formed of fine abrasive grains having an average abrasive grain size of 1 μm or below like a size #6000 to 8000 has been advanced to further improve surface roughness or a damage depth.

When the grinding stone was formed of such diamond abrasive grains having an average abrasive grain size of 1 μm or below and a vitrified bond material, a grinding load was increased and, in a conventional apparatus, a stress applied to the workpiece during grinding increases, a support effect by a static pressure of a fluid was not able to be obtained, the workpiece holder was apt to be inclined, and controlling a position of the workpiece holder was difficult. However, according to the present invention, even if a grinding stone of a higher size that increases such a grinding load is provided, and a position of the workpiece holder can be controlled, namely, a nanotopography of the workpiece can be sufficiently suppressed from being degraded.

Further according to the present invention, there is provided a workpiece double-disc grinding method comprising at least: using a workpiece holder to support a thin-plate-like workpiece from outer peripheral side along a radial direction and rotate the same; supporting the workpiece holder from both sides along an axial direction of rotation in a contactless manner based on a static pressure of a fluid by a pair of static pressure support members positioned on both sides of the workpiece holder; and simultaneously grinding both surfaces of the workpiece supported by the workpiece holder by a pair of grinding stones, wherein an interval between the workpiece holder and the static pressure support member is set to not greater than 50 μm and the static pressure of the fluid is set to not lower than 0.3 MPa to grind both the surfaces of the workpiece.

As described above, when the interval between the workpiece holder and the static pressure support member can be set to not greater than 50 μm and a static pressure of the fluid can be adjusted to not lower than 0.3 MPa to grind both the surfaces of the workpiece, the double-disc grinding for the workpiece can be carried out while stabilizing a position of the workpiece holder that supports the workpiece, thereby remarkably suppressing degradation of the nanotopography of the workpiece. Furthermore, a variation in the nanotopography level is smaller than those in conventional examples, and the nanotopography level can be improved to a higher level.

At this time, it is preferable that the workpiece holder has parallelism of 5 μm or below and flatness of 5 μm or below.

Adopting this configuration enables sufficiently suppressing a load when rotating the workpiece holder and the workpiece supported by the workpiece holder, and the double-disc grinding can be more smoothly carried out.

Moreover, it is preferable that at least the surface of the workpiece holder that is supported in the contactless manner is formed of alumina ceramics.

When alumina ceramics is utilized, workability at the time of molding the workpiece holder is excellent, the workpiece holder is hard to be thermally expanded by heat generated at the time of processing, and shape accuracies of the surface of the workpiece holder that is supported in the contactless manner can be increased, whereby the load applied at the time of the double-disc grinding can be further reduced.

Additionally, it is preferable that a surface of the static pressure support member that supports the workpiece holder in the contactless manner has flatness of 20 μm or below.

When this configuration is adopted, the load is hard to be applied at the time of rotating the workpiece holder, and the double-disc grinding can be more smoothly performed.

Further, the grinding stone can be formed of diamond abrasive grains having an average grain size of 1 μm or below and a vitrified bond material.

Even if the grinding stone is formed of such a material that increases a grinding load, a position of the workpiece holder can be controlled, and the nanotopography of the workpiece can be sufficiently suppressed from being degraded.

According to the workpiece double-disc grinding apparatus and the workpiece double-disc grinding method of the present invention, a variation is small and the nanotopography can be dramatically suppressed in the workpiece after the double-disc grinding. In particular, the grinding stone having a higher size that is formed of fine abrasive grains whose average grain size is 1 μm or below can be utilized to decrease a manufacturing cost based on a reduction in a processing amount in a post-process and obtain the highly accurate nanotopography.

BEST MODES FOR CARRYING OUT THE INVENTION

An embodiment according to the present invention will now be described hereinafter, but the present invention is not restricted thereto.

As a result of keenly conducting studies about a relationship between a double-disc grinding apparatus, a double-disc grinding method and a nanotopography of a workpiece after grinding, the present inventors have discovered that positional control over a workpiece holder as supporting means, which is provided along a radial direction of the workpiece, in an axial direction of rotation thereof is important. It was considered that such control did not affect a wafer quality, e.g., a nanotopography conventionally.

Figure 11:
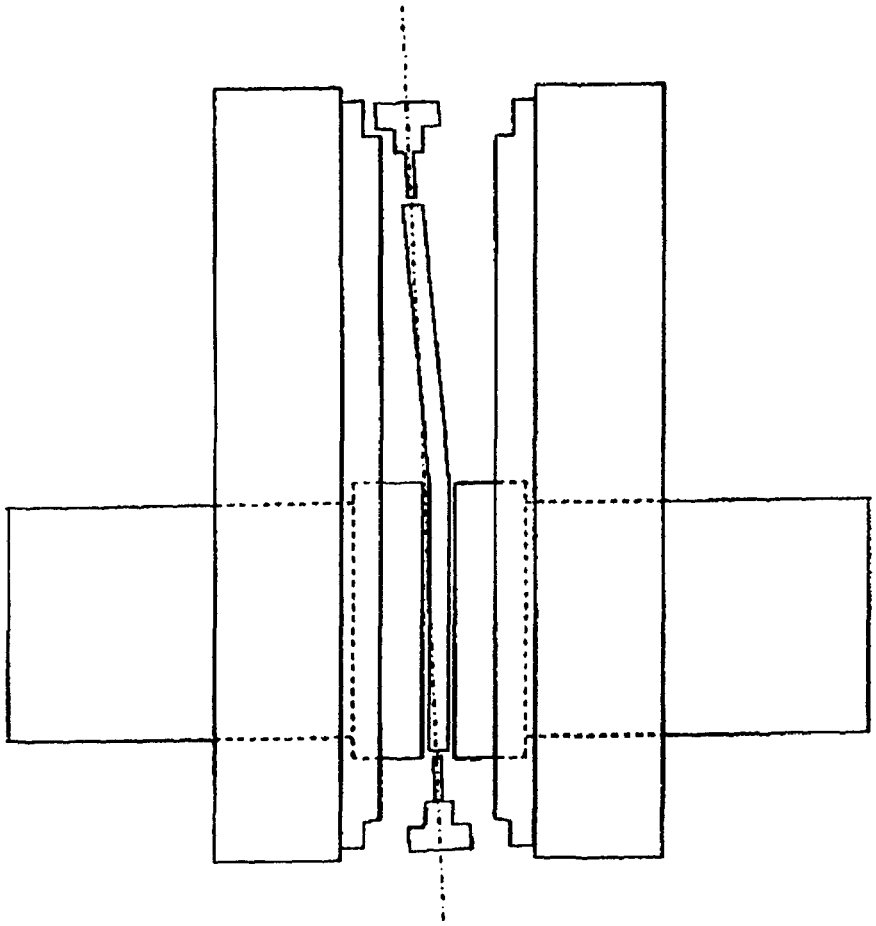
FIG. 11 is an explanatory view showing a state that a workpiece holder is down without fixing its position in a conventional double-disc grinding method.
Figure 12:
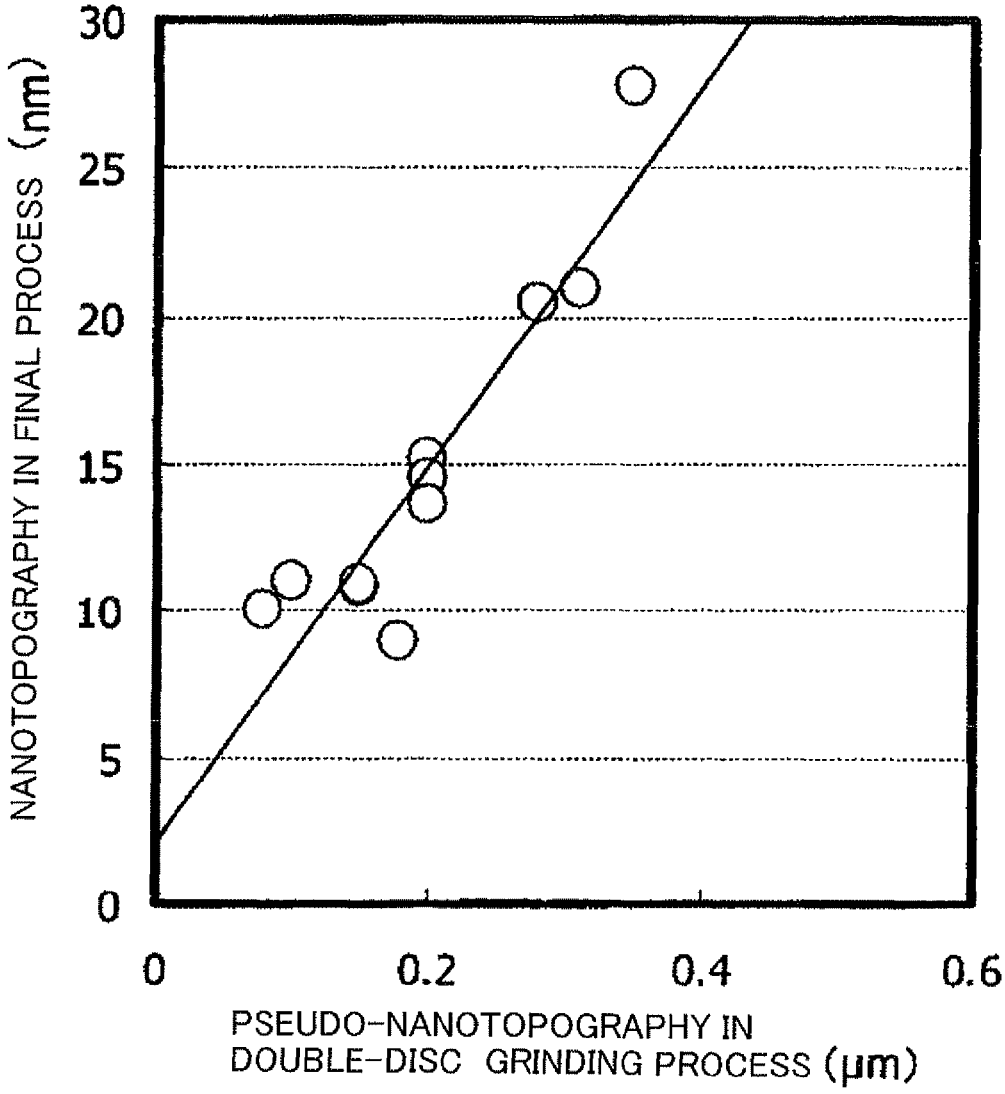
FIG. 12 is a graph showing a relationship between a value of a pseudo-nanotopography after a double-disc grinding process and a value of a nanotopography after a final process.

Further, they have further advanced the studies and thereby revealed that a value of 200 to 500 μm is general as an interval between a workpiece holder and a static pressure support member (i.e., an interval between a surface of the workpiece holder that is supported in a contactless manner and a surface of the static pressure support member that supports the workpiece holder in the contactless manner) in conventional examples but a support effect based on a static pressure of a fluid cannot be obtained when this dimension is adopted. That is, it has been found out that control over a position of the workpiece holder along an axial direction of rotation of the workpiece holder is impossible. Therefore, as shown in FIG. 11, it has been understood that a posture is apt to be distorted and a position of the workpiece holder in the axial direction of rotation thereof is not fixed. Falling of the workpiece holder during grinding causes displacement of an inserted workpiece in an axial direction of rotation thereof and leads to degradation in a nanotopography.

Furthermore, in particular, the present inventors have also discovered that the falling of the workpiece holder becomes considerable when a grinding stone having a high size of fine abrasive grains (e.g., 1 μm or below) with a high grinding load is used.

Moreover, to improve a cost based on a reduction in, e.g., a polishing amount in a double-side polishing process as a process after double-disc grinding using such a grinding stone having a high size in particular or improve a nanotopography of the workpiece after grinding while considering an improvement in surface roughness or a damage depth, the present inventors have revealed that the interval between the workpiece holder and the static pressure support member is set to not greater than 50 μm, a static pressure of the fluid required to hydrostatically support the workpiece holder is adjusted to not lower than 0.3 MPa and both surfaces of the workpiece supported by the workpiece holder are ground. The present inventors have discovered that the workpiece holder is stably supported during grinding under such conditions and positional control is also appropriately performed, thereby bringing the present invention to completion.

Figure 1:
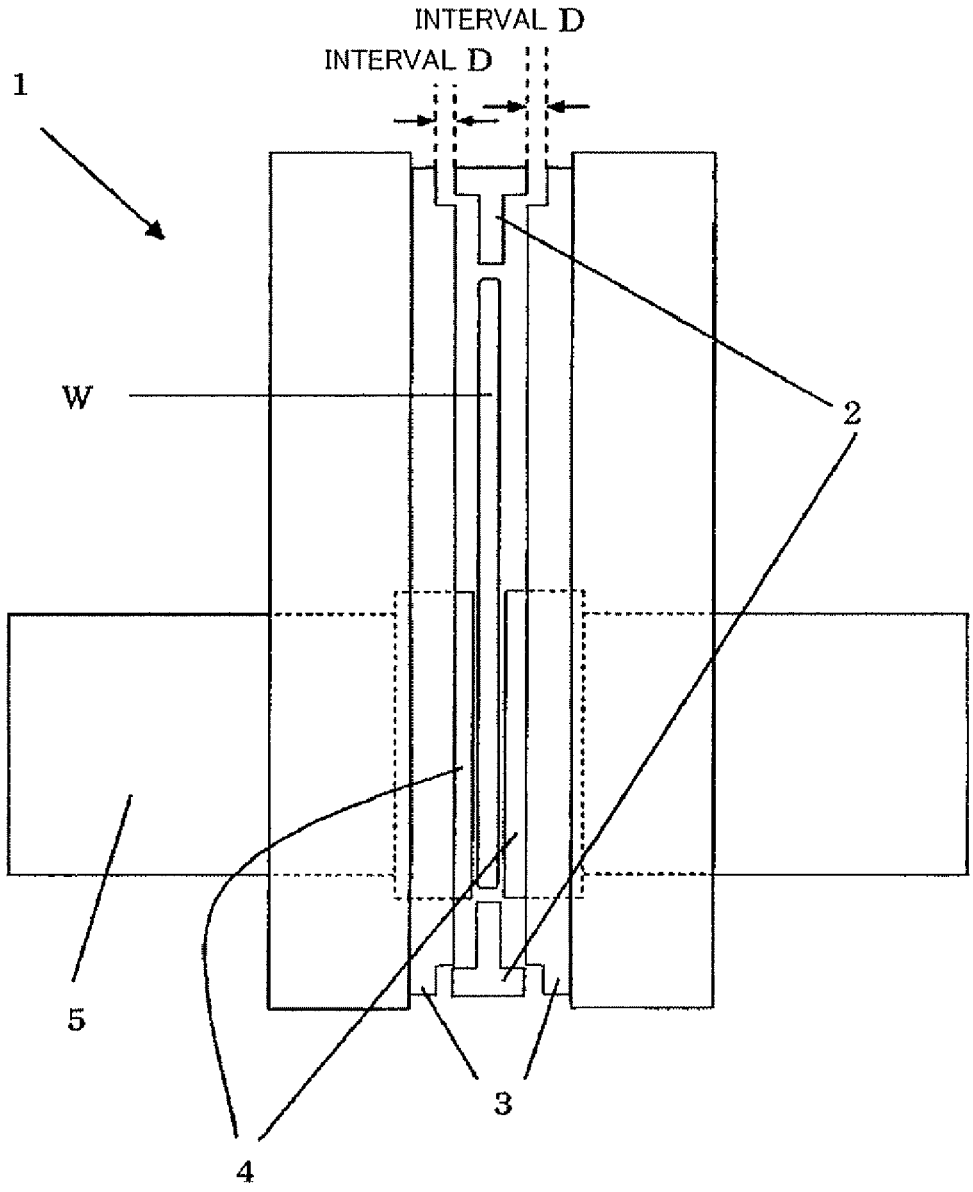
FIG. 1 is a schematic view showing an example of a double-disc grinding apparatus according to the present invention.

FIG. 1 is a schematic view showing an example of a double-disc grinding apparatus according to the present invention. A double-disc grinding apparatus 1 mainly includes a workpiece holder 2 that supports a workpiece W, a pair of static pressure support members 3 that support the workpiece holder 2 in a contactless manner by using a static pressure of a fluid, and a pair of grinding stones 4 that simultaneously grind both surfaces of the workpiece W.

Figure 2:
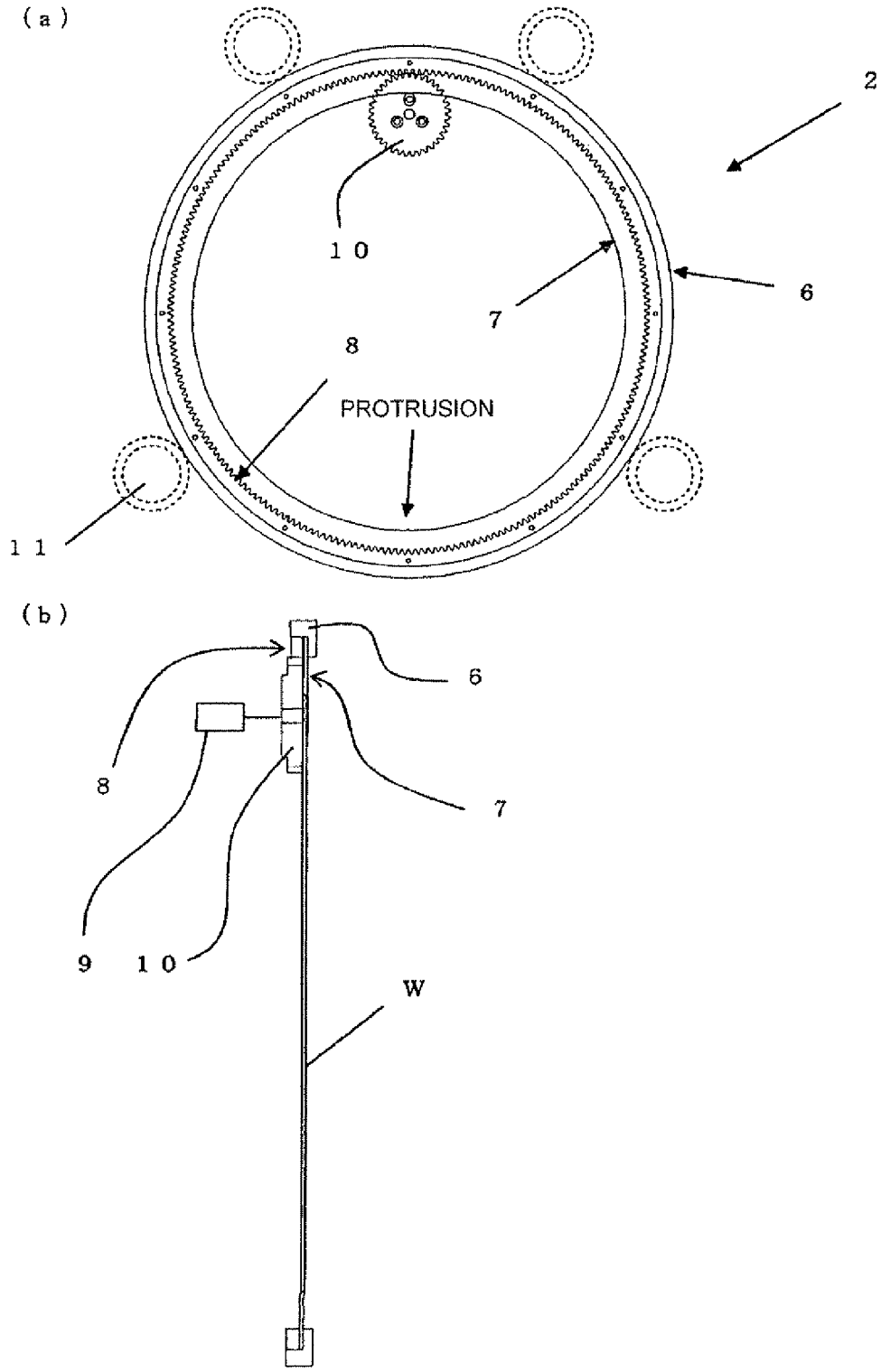
FIG. 2 are schematic views showing an example of a workpiece holder, where (a) is an overall view and (b) is a cross-sectional view.

The workpiece holder 2 will be first described. FIG. 2 show an outline of the workpiece holder 2. As shown in an overall view of FIG. 2(*a*) and a cross-sectional view of (b), the workpiece holder 2 mainly has a ring-like ring portion 6 having a L-shaped cross section, a support portion 7 that is in contact with the workpiece W and supports the same from an outer peripheral side along a radial direction of the workpiece W, and an internal gear portion 8 that is utilized to rotate the workpiece holder 2, and the internal gear portion 8 is screwed to an inner side of the L-like shape of the ring portion 6 through the support portion 7.

Additionally, a drive gear 10 connected with a motor 9 is arranged to rotate the workpiece holder 2 and meshed with the internal gear portion 8, and rotating the drive gear 10 by using the motor 9 enables rotating the workpiece holder 2 through the internal gear portion 8. Further, as shown in FIG. 2(*a*), a protrusion that protrudes toward the inner side is formed at a part of an edge portion of the support portion 7, and it fits with a notched shape called a notch formed at a peripheral portion of the workpiece W, thereby transmitting a rotating operation of the workpiece holder 2 to the workpiece W.

Furthermore, the workpiece holder 2 is rotatably supported by three or more rollers 11 that freely rotate in a periaxial direction of rotation. In the example depicted in FIG. 2(*a*), the four rollers 11 are arranged, but the present invention is not restricted thereto.

The ring portion 6 having a surface that is supported by the static pressure support members 3 in a contactless manner is formed of, e.g., alumina ceramics. When the material is alumina ceramics in this manner, since workability is excellent and thermal expansion hardly occurs during processing, the surface supported in the contactless manner can be highly accurately processed into a desired shape.

Moreover, a resin can be used as a material of the support portion 7, and SUS can be used as materials of the internal gear portion 8 and the drive gear 10, but the present invention is not restricted thereto.

The static pressure support member 3 will now be described.

Figure 3:
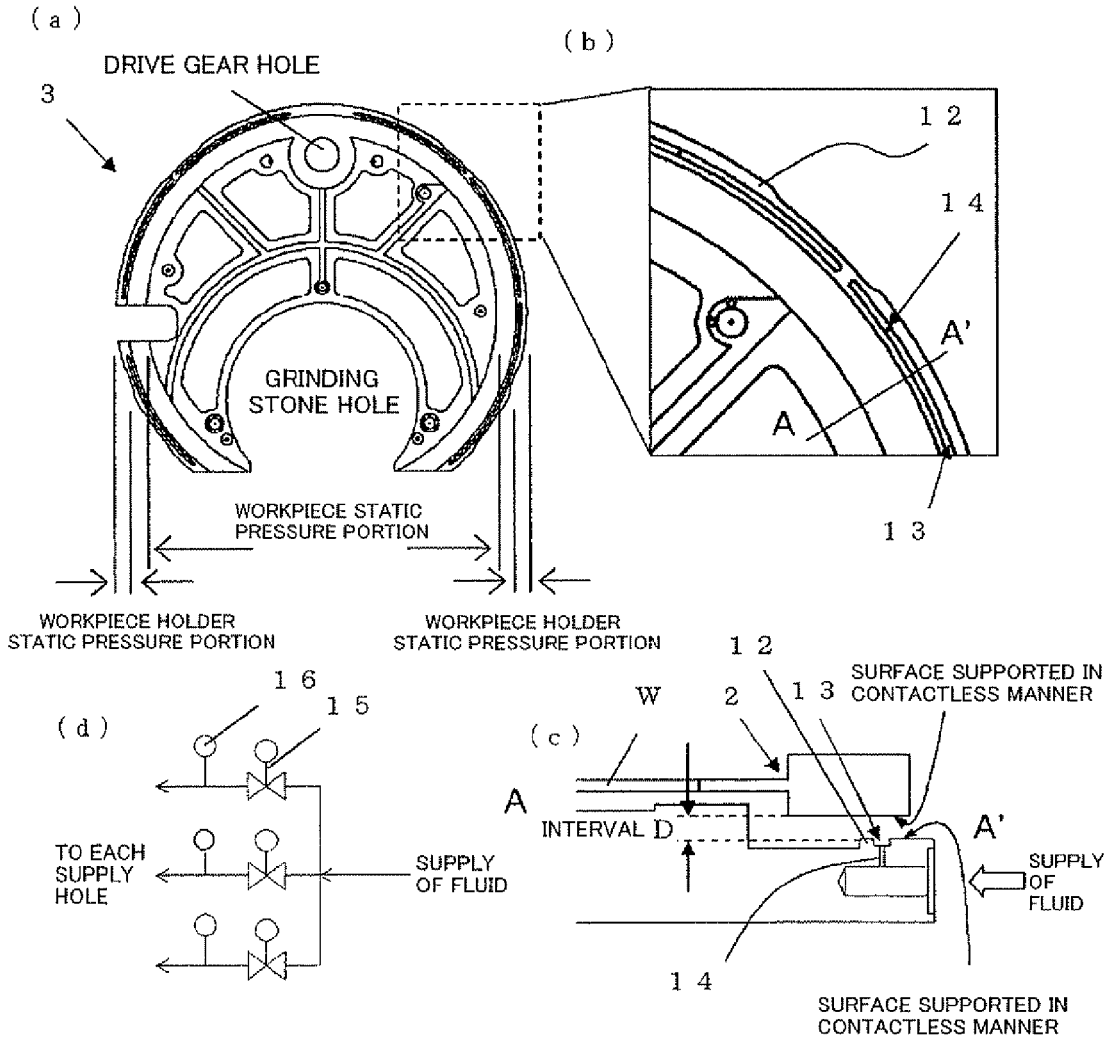
FIG. 3 are schematic views showing an example of a static pressure support member, wherein (a) is an overall view, (b) is an enlarged view of a workpiece holder static pressure portion, (c) is a cross-sectional view taken along a line A-A' and (d) is a fluid supply line.

FIG. 3 show an outline of the static pressure support member 3. First, FIG. 3(*a*) shows the entire static pressure support member 3. An outer peripheral side is a workpiece holder static pressure portion that supports the workpiece holder 2 in the contactless manner, and an inner peripheral side is a workpiece static pressure portion that supports the workpiece W in the contactless manner. Additionally, a hole into which a drive gear 10 that is utilized to rotate the workpiece holder 2 is inserted and a hole into which the grind stone 4 is inserted are formed in the static pressure support member 3.

FIG. 3(*b*) shows the partially enlarged a part of workpiece holder static pressure portion. Further, FIG. 3(*c*) is a cross-sectional view taken along A-A' in FIG. 3(*b*).

As depicted in FIGS. 3(*b*) and (*c*), a front surface has an embankment 12 and pockets 13 that are concave portions surrounded by the embankment 12, and a supply hole 14 through which a fluid (e.g., water) is supplied to the pocket 13 from a fluid supply opening is formed in each pocket 13.

Furthermore, FIG. 3(*d*) shows a line for supplying the fluid to each supply hole 14, and each line is provided with a valve 15 and a pressure gauge 16. These members can be utilized to adjust a static pressure of the fluid that is supplied to each pocket 13 via each supply hole 14. When actually effecting double-disc grinding, a static pressure is adjusted to not lower than 0.3 MPa, and this static pressure is utilized to support the workpiece holder 2 in the contactless manner.

Moreover, as shown in FIG. 1, the static pressure support members 3 are arranged on both sides of the workpiece holder 2. Additionally, each static pressure support member 3 is attached to means for adjusting a position thereof (not shown), and an interval between the workpiece holder 2 and each static pressure support member 3, i.e., as shown in FIG. 3(*c*) an interval D between the surface of the workpiece holder 2 that is supported in the contactless manner and the surface of the static pressure support member 3 that supports the workpiece holder in the contactless manner is set to not greater than 50 μm at the time of double-disc grinding.

It is to be noted that a configuration of the workpiece static pressure portion is not restricted in particular, and the mechanism for supplying the fluid may not be provided, or an embankment, pockets and supply holes may be provided like Japanese Unexamined Patent Publication (Kokai) No. 2007-96015 to enable supplying the fluid to the space between the workpiece W and each static pressure support member 3.

Further, the grinding stone 4 is not restricted in particular, and one having a size #3000 whose average abrasive grain size is 4 μm can be used like conventional examples, for example. Furthermore, a grinding stone having a higher size #6000 to 8000 can be also utilized. For example, there is a grinding stone which is formed of diamond abrasive grains whose average grain size is 1 μm or below and a vitrified bond material. It is to be noted that each grinding stone 4 is connected with the motor 5 so that it can rotate at a high speed.

Although the interval between the surface of the workpiece holder that is supported in the contactless manner and the surface of the static pressure support member that supports the workpiece holder in the contactless manner is 200 to 500 μm in a conventional apparatus, a grinding load is high when using the grinding stones having a high size in particular, and stabilizing a position of the workpiece holder along the axial direction of rotation thereof is difficult.

However, in the double-disc grinding apparatus 1 according to the present invention, even the grinding stones 4 having a high size is used, the workpiece holder 2 is supported with the interval D that is not greater than 50 μm and the fluid static pressure that is not lower than 0.3 MPa, thus sufficiently stabilizing the position of the workpiece holder 2 along the axial direction of the rotation thereof. Therefore, grinding using the grinding stones having a high size that applies a high load can be carried out, a nanotopography can be considerably suppressed from being degraded as compared with conventional examples, and the workpiece can be ground with a high quality.

Moreover, when the grinding stones 4 having a high size are adopted, a polishing amount in a double-side polishing process after the double-disc grinding can be reduced, and an improvement in productivity and a reduction in cost can be achieved, and surface roughness or a damage depth in the double-disc grinding can be improved.

Although the respective structures, e.g., the workpiece holder 2, the static pressure support members 3, the grinding stones 4 and others in the double-disc grinding apparatus 1 according to the present invention have been described above, more preferred embodiments of the workpiece holder 2 and the static pressure support members 3 will now be explained.

First, the present inventors examined shape accuracies of the workpiece holder 2 and each static pressure support member 3 in the double-disc grinding apparatus 1 according to the present invention.

Specifically, to set the interval D between the workpiece holder 2 and each static pressure support member 3 to not greater than 50 μm, an apparatus in which flatness and parallelism of the workpiece holder 2 and flatness of the surface of each static pressure support member 3 that supports the workpiece holder 2 in the contactless manner were changed and combined was utilized to conduct an experiment of examining a rotating status by supporting the workpiece holder 2 in the contactless manner based on a static pressure of water and rotating the workpiece holder 2. As each grinding stone, one having a high size #8000 was used.

Figure 4:
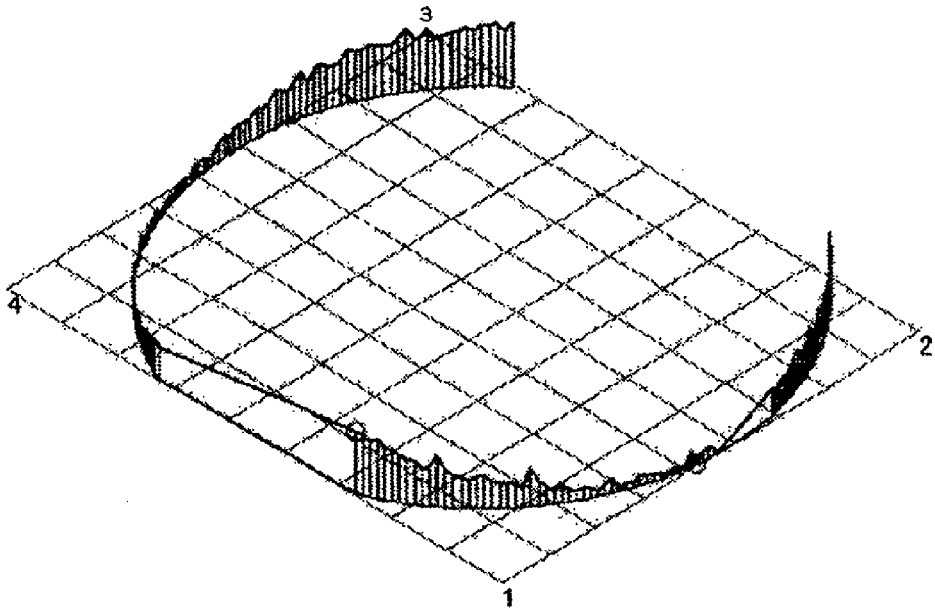
FIG. 4 is a measurement view showing an example of a shape measurement result of a static pressure support member.

First, the plurality of static pressure support members 3 and the plurality of workpiece holders 2 were prepared, and a three-dimensional measuring machine ZYZAXRVA-A (manufactured by Tokyo Seimitsu Co., Ltd.) was utilized to select two levels (flatness of 15 μm and 20 μm) in regard to the static pressure support member 3 and three levels (flatness of 50 μm and parallelism of 10 μm; flatness of 15 μm and parallelism of 10 μm; and flatness of 5 μm and parallelism of 5 μm) in regard to the workpiece holder 2. FIG. 4 shows an example of a result of shape measurement of the static pressure support member.

These members were combined to set the interval D between the workpiece holder 2 and each static pressure support member 3 to 50 μm, and then a rotating status of the rotation of the workpiece holder 2 was examined. It is to be noted that a static pressure of water to be supplied was set to 0.3 MPa.

Table 1 shows combinations of flatness and parallelism of the workpiece holder 2 and the static pressure support member 3 and rotating states.

TABLE 1

| STATIC PRESSURE SUPPORT MEMBER FLATNESS (e) | WORKPIECE HOLDER FLATNESS (h − g) | PARALLELISM (f) | e + f + (h − g)/2 | ROTATING STATE |
|---|---|---|---|---|
| 15 | 50 | 10 | 50 | HIGH LOAD |
| 20 | 15 | 10 | 37.5 | HIGH LOAD |
| 20 | 5 | 5 | 27.5 | GOOD |
| 15 | 5 | 5 | 22.5 | GOOD |

As shown in Table 1, in a combination of large flatness and large parallelism, a phenomenon that a load of the motor that rotates the drive gear 10 was higher than usual even though the workpiece holder 2 rotated was confirmed, and it was revealed that the workpiece holder 2 was in contact with the static pressure support member 3.

Figure 5:
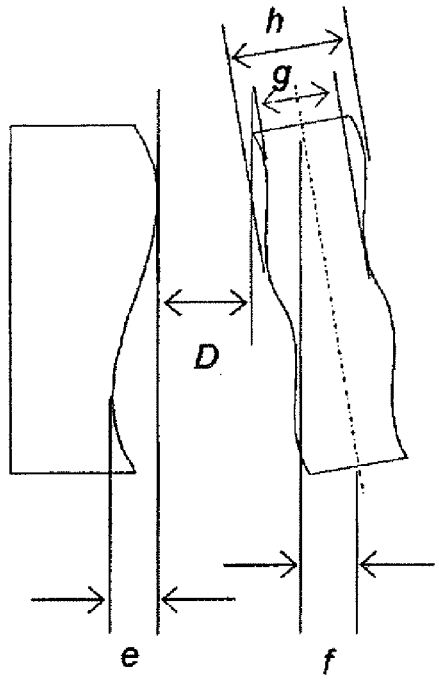
FIG. 5 is an explanatory view showing shapes and a positional relationship of the workpiece holder and the static pressure support member.

In regard to a relationship of the interval D between the workpiece holder 2 and the static pressure support member 3 and each shape, the interval D between the workpiece holder 2 and the static pressure support member 3 can be represented as $D=e+f+(h-g)/2+\alpha$, where e is flatness of the static pressure support member 3, f is parallelism of the workpiece holder 2, h−g is flatness of the workpiece holder 2, and α is a thickness of a static pressure water film as shown in FIG. 5. Here, since the static pressure water film thickness α is hard to be measured, other dimensions cannot be specified, but a necessary condition is that a numeric value of $e+f+(h-g)/2$ is 30 μm or below based on a result of the rotating state depicted in Table 1.

However, in regard to shape accuracies of the static pressure support member 3 and the workpiece holder 2 at the time of processing, the workpiece holder 2 can have a higher shape accuracy since its shape is simple, and there is a limit in a shape accuracy of the static pressure support member 3 having a complicated shape. Thus, it is preferable that a numeric value of $e+f+(h-g)/2$ is not greater than 30 μm, the flatness of the static support member 3 is not greater than 20 μm, the flatness of the workpiece holder 2 is not greater than 5 μm and the parallelism of the same is not greater than 5 μm as realistic shape accuracies.

In particular, the accuracies of the workpiece holder 2, i.e., the flatness that is not greater than 5 μm and the parallelism that is not greater than 5 μm cannot be obtained in conventionally utilized SUS 304 having a thermal expansion coefficient of approximately $17\times10^{-6}/°$ C. because of heat generation at the time of processing. These accuracies can be easily achieved by using alumina ceramics having a thermal expansion coefficient of $6\times10^{-6}/°$ C. as the ring portion 6 of the workpiece holder 2.

It is to be noted that, in regard to the combination of two levels that a numeric value of $e+f+(h-g)/2$ becomes not greater than 30 μm (the workpiece holder 2 has the parallelism of 5 μm and the flatness of 5 μm and the surface of the static pressure support member 3 that supports the workpiece holder in the contactless manner is 20 μm or 15 μm), a pseudo-nanotopography measured after grinding the workpiece fell below 0.2 μm, and a very excellent level is confirmed.

Based on the above-described examination, it was understood that the workpiece holder 2 having the parallelism of 5 μm or below and the flatness of 5 μm or below and the static pressure support member 3 having the flatness of 20 μm or below on the surface that supports the workpiece holder 2 in the contactless manner are preferable. It is to be noted that the parallelism of each static pressure support member 3 on both sides can be subjected to parallel adjustment at the time of assembling.

Further, the present inventors have discovered that the double-disc grinding apparatus that satisfies such conditions can effectively prevent that a load of the motor 9 for the drive gear 10 increases, particle generation occurs due to abrasion between the internal gear portion 8 and the drive gear 10, and generated foreign particles enter the interval between the workpiece holder 2 and the static pressure support member 3 even though the interval D between the workpiece holder 2 and the static pressure support member 3 has a small value, i.e., 50 μm or below. Thereby, as a result, a phenomenon and others that avoid rotation of the workpiece holder 2 can be prevented from occurring, for example.

The workpiece double-disc grinding method according to the present invention will now be described.

Here, although a description will be given as to a situation where the double-disc grinding apparatus 1 according to the present invention depicted in FIG. 1 is used, the present invention is not restricted thereto, and a method that sets the interval D between the workpiece holder 2 and the static pressure support member 3 to not greater than 50 μm and adjusts a static pressure of the fluid to not lower than 0.3 MPa to grind both surfaces of the workpiece W can suffice.

The workpiece W (e.g., a silicon wafer) is held from an outer peripheral side along the radial direction of the workpiece W to be supported by the support portion 7 of the workpiece holder 2.

The workpiece holder 2 that supports the workpiece W is supported between the pair of static pressure support members 3 in such a manner that each static pressure support member 3 and the workpiece holder 2 have an interval. At this time, water as the fluid is supplied from the supply hole 14 of each pocket 13 of the static pressure support members 3 to adjust the static pressure to not lower than 0.3 MPa in accordance with each pocket 13. Moreover, the interval D between each static pressure support member 3 and the workpiece holder 2 is adjusted to not greater than 50 μm.

The workpiece holder 2 that supports the workpiece W from the outer peripheral side is supported by using the static pressure support members 3 based on the static pressure of water in the contactless manner, and the grinding stones 4 are rotated by using the motor 5 while rotating the workpiece holder 2 by the drive gear 10, thereby simultaneously grinding both surfaces of the workpiece W.

To avoid degradation of the nanotopography of the workpiece W, control over a position of the workpiece holder 2 that supports the workpiece W along the axial direction of the rotation thereof is an important factor. Since the double-disc grinding method according to the present invention enables double-disc grinding for the workpiece W while controlling the workpiece holder 2 to an appropriate position along the axial direction of the rotation thereof, the nanotopography can be improved to a high level with less variation as compared with conventional examples. For example, the pseudo-nanotopography can be set to 0.2 μm or below at the time of double-disc grinding, whereby the nanotopography can be suppressed to 15 nm or below in a final product. This is the level that can sufficiently satisfy recent demands from customers.

It is to be noted that, if the ring portion 6 having the surface that is supported in the contactless manner is formed of alumina ceramics in the workpiece holder 2, the surface that is supported in the contactless manner can be processed with a high shape accuracy and, in particular, the workpiece holder 2 having the parallelism of 5 μm or below and the flatness of 5 μm or below can be provided.

Additionally, it is preferable for each static pressure support member 3 to have the flatness of 20 μm or below.

When the workpiece holder 2 or each static pressure support member 3 having such a shape is utilized to perform double-disc grinding, an influence on the rotation of the workpiece holder 2 can be eliminated without bringing the workpiece holder 2 and each static pressure support member 3 into contact with each other even though the interval D between these members is as narrow as not greater than 50 μm during grinding.

Further, as each grinding stone 4, one with a high size that is formed of diamond abrasive grains having an average grain size of 1 μm or below and a vitrified bond material can be used. In conventional examples, when such a grinding stone with a high size is used, positional control of the workpiece holder cannot be performed due to a load at the time grinding, and the nanotopography of the workpiece W is degraded. However, according to the present invention, even if the grinding stones with a high size are used, positional control of the workpiece holder can be effected, and degradation in the nanotopography of the workpiece can be sufficiently suppressed. Further, using the grinding stones with a high size enables reducing a polishing amount in a later double-side grinding process, thereby achieving a reduction in cost or an improvement in surface roughness or a damage depth.

The present invention will now be explained in more detail based on examples, but the present invention is not restricted thereto.

EXAMPLE 1

By using the double-disc grinding apparatus 1 according to the present invention depicted in FIG. 1, double-disc grinding of a workpiece (a silicon wafer having a diameter of 300 mm) was curried out based on the double-disc grinding method according to the present invention.

As a workpiece holder, one having a ring portion formed of alumina ceramics was used. The workpiece holder has flatness of 5 μm and parallelism of 5 μm, and static pressure support members have flatness of 15 μm.

An interval between the workpiece holder and each static pressure support member was set to 30 μm. Furthermore, water was supplied from supply holes of each static pressure support member, and the workpiece holder was supported in a contactless manner based on a static pressure of 0.6 MPa. Moreover, as grinding stones, a grinding stone SD #3000 and a grinding stone SD #8000 that are formed of diamond abrasive grains having an average grain size of 1 μm or below and a vitrified bond (vitrified bond grinding stones manufactured by Allied Material Corporation) were used.

A grinding amount is 30 μm.

Figure 6:
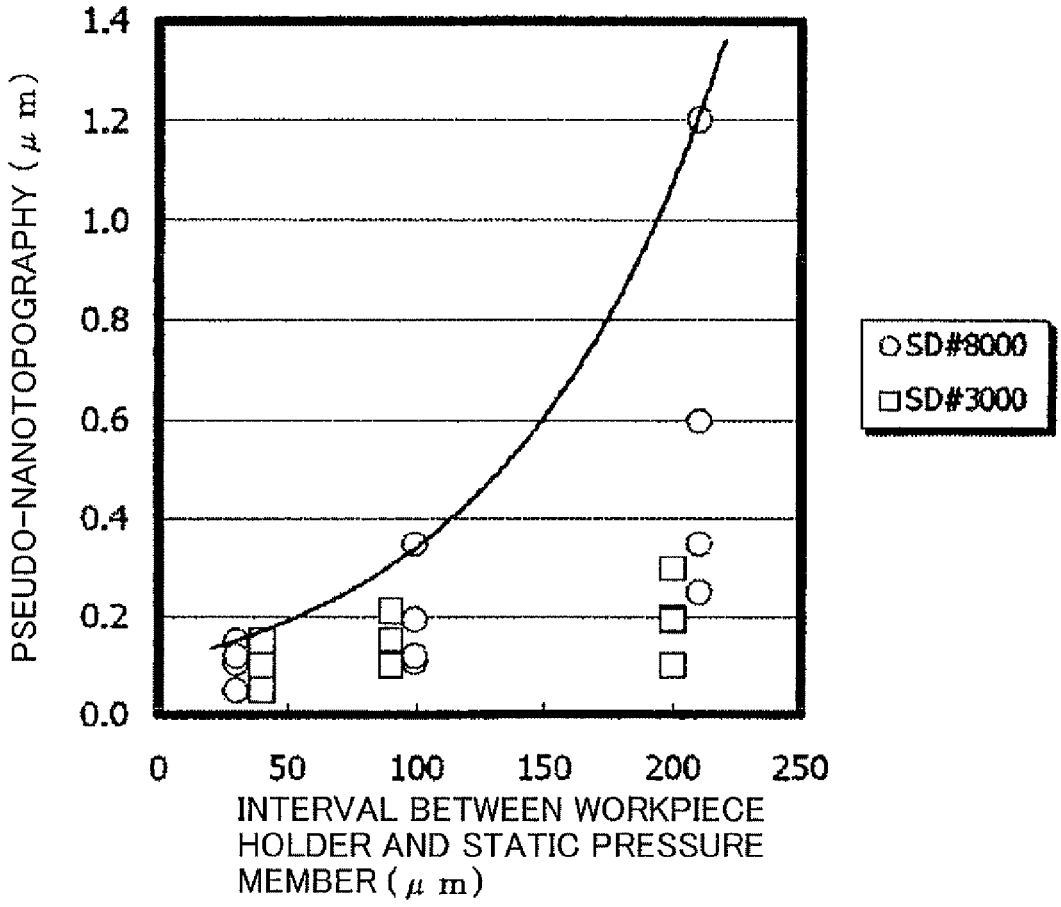
FIG. 6 shows measurement results of pseudo-nanotopographies according to Example 1 and Comparative Example 1.

FIG. 6 shows an interval between the workpiece holder and each static pressure support member and a result of a pseudo-nanotopography of the ground workpiece.

As shown in FIG. 6, in both cases using the respective grinding stones, a variation is smaller than those in later-described comparative examples, and the pseudo-nanotopography was successfully suppressed to an excellent level, i.e., 0.2 μm or below. In particular, it can be understood that an excellent result is demonstrated even though the grinding stone with a high size SD #8000 was utilized.

Comparative Example 1

Double-disc grinding for a workpiece (a silicon wafer having a diameter of 300 mm) was carried out like Example 1 except that an interval between a workpiece holder and each static pressure support member is set to 100 μm or 200 μm.

As shown in FIG. 6, a variation in a pseudo-nanotopography is larger than that in Example 1, and the pseudo-nanotopography exceeds 0.2 μm in some cases. It can be understood that the interval between each static pressure support member and the workpiece holder must be set to not greater than 50 μm like the present invention in order to assuredly suppress the pseudo-nanotopography to 0.2 μm or below.

Incidentally, it is clear that a value of the pseudo-nanotopography is reduced as the interval between each static pressure support member and the workpiece holder is narrowed. When the grinding stone SD #8000 is used, this tendency becomes more considerable, and the pseudo-nanotopography is precipitously degraded as the interval between the workpiece holder and each static pressure support member becomes wider.

EXAMPLE 2

Comparative Example 2

Double-disc grinding for a workpiece (a silicon wafer having a diameter of 300 mm) was performed like Example 1 except that the grinding stone SD #8000 was used as each grinding stone and a static pressure value of water was changed and set.

The static pressure of water was set to 0.3 MPa, 0.8 MPa and 1.0 MPa (These are Example 2), and 0.2 MPa (Comparative Example 2).

Figure 7:
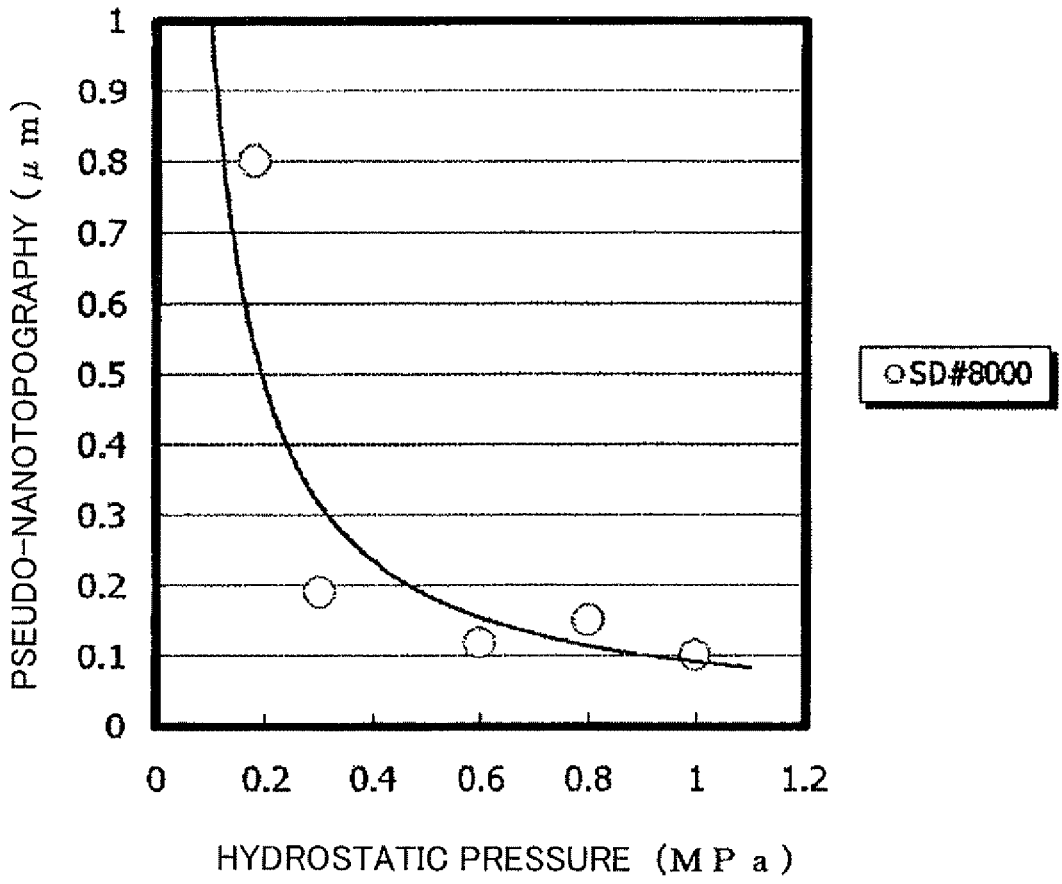
FIG. 7 shows measurement results of pseudo-nanotopographies according to Example 2 and Comparative Example 2.
Figure 8:
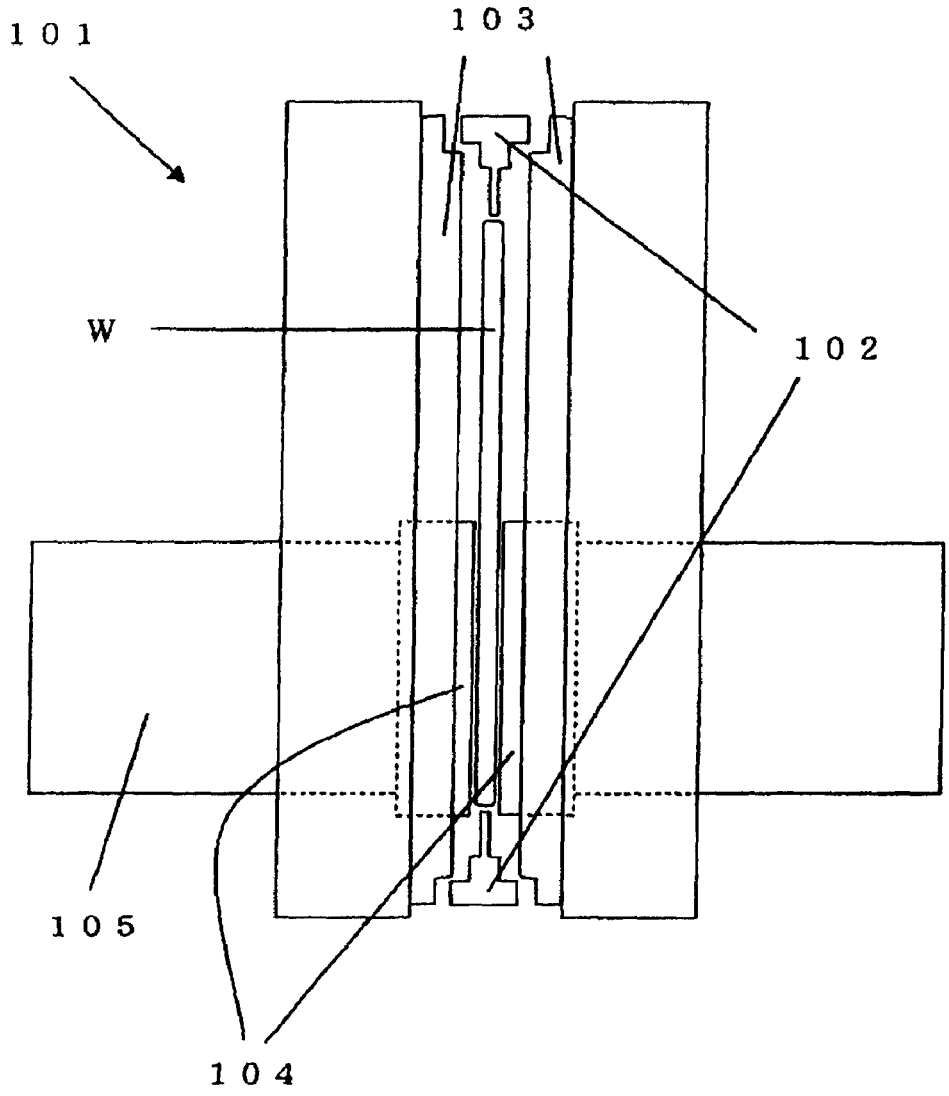
FIG. 8 is a schematic view showing an example of a conventional double-disc grinding apparatus.
Figure 9:
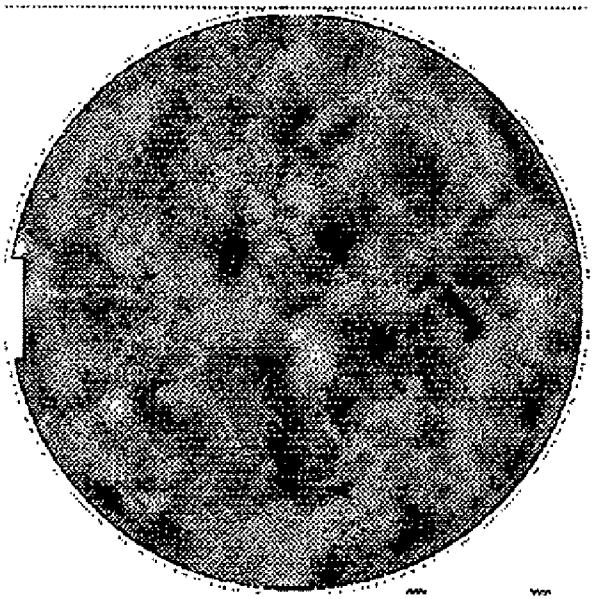
FIG. 9 are measurement views showing examples of nanotopography maps measured by Nanomapper, wherein (a) shows an example where a nanotopography level is good and (b) shows an example where a nanotopography level is bad.
Figure 9:
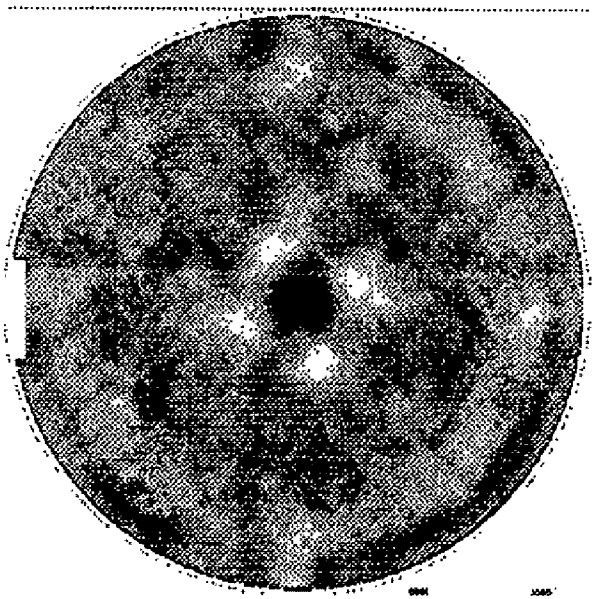
Figure 10:
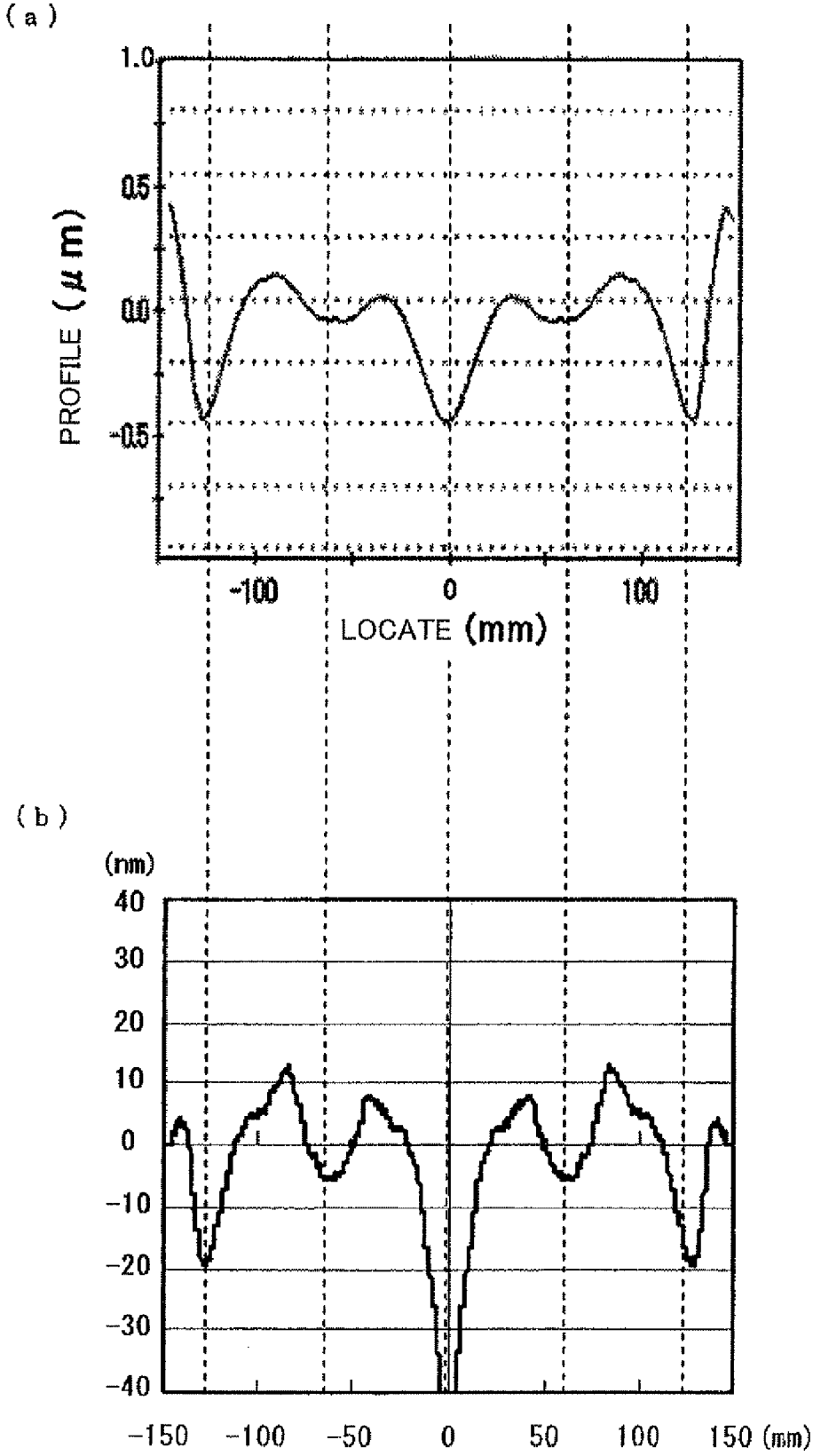
FIG. 10(*a*) is a graph showing an example of a pseudo-nanotopography obtained by performing bandpass filter processing with respect to a Sori shape measured by a measuring instrument adopting a capacitance system, and FIG. 10(*b*) is a graph showing an example of a nanotopography measured by Nanomapper.

FIG. 7 shows a static pressure value of water and a result of a pseudo-nanotopography of each ground workpiece. It is to be noted that a value of the pseudo-nanotopography according to Example 1 is also shown as a reference (a value when a hydrostatic pressure is 0.6 MPa).

The pseudo-nanotopography is as large as 0.8 μm in Comparative Example 2, and the pseudo-nanotopography was suppressed to 0.2 μm or below under each hydrostatic pressure in Example 2.

As described above, when the static pressure value is smaller than 0.3 MPa, the pseudo-nanotopography becomes considerably large, and a high-quality ground workpiece cannot be obtained. It can be understood that setting the static pressure value to not lower than 0.3 MPa enables suppressing the pseudo-nanotopography to one on an excellent level.

Additionally, it can be understood from Examples 1 and 2 and Comparative Examples 1 and 2 that the interval between the workpiece holder and each static pressure support member must be set to not greater than 50 μm and the static pressure support members must support the workplace holder in the contactless manner based on a static pressure of not lower than 0.3 MPa like the present invention in order to obtain a ground workpiece having a pseudo-nanotopography on a high level.

Comparative Example 3

A conventional double-disc grinding apparatus was utilized to perform double-disc grinding for a workpiece (a silicon wafer having a diameter of 300 mm).

The utilized double-disc grinding apparatus XSG-320 (manufactured by Koyo Machine Industries Co., Ltd.) is a conventional standard apparatus, and actual measurement using a three-dimensional shape measuring machine ZYZA-XRVA-A (manufactured by Tokyo Seimitsu Co., Ltd.) revealed that a workpiece holder formed of SUS has parallelism of 10 μm and flatness of 50 μm and each static pressure support member has flatness of 20 μm.

An interval between the workpiece holder and each static pressure support member was set to a standard value, i.e., 200 μm, and a hydrostatic pressure was set to 0.6 MPa. Moreover, as each grinding stone, a grinding stone SD #3000 that is formed of a vitrified bond and has a diameter of 160 mm (a vitrified bond grinding stone manufactured by Allied Material Corporation) was used.

A grinding amount is 30 μm.

As a result of measuring a pseudo-nanotopography of a ground workpiece, a variation was very large, and it was 0.6 μm on average and 1.2 μm at a maximum. A pseudo-nanotopography target value 0.2 μm was not satisfied. As a cause of this variation, it can be considered that the workpiece holder is apt to fall over in the interval of 200 μm and the falling of the workpiece holder results in a deviation of a central position of the workpiece and deformation of the workpiece.

It is to be noted that the present invention is not restricted to the foregoing embodiment. The foregoing embodiment is just an exemplification, and any examples that have substantially the same configuration and demonstrate the same functions and effects as the technical concept described in claims of the present invention are included in the technical scope of the present invention.

The invention claimed is:

1. A workpiece double-disc grinding apparatus comprising:

a workpiece holder that supports a thin-plate-like workpiece from an outer peripheral side along a radial direction and is able to rotate;

a pair of static pressure support members that are positioned on two opposing sides of the workpiece holder and support the workpiece holder from the two opposing sides along an axial direction of the rotation thereof in a contactless manner by a static pressure of a fluid supplied by the pair of static pressure support members; and a pair of grinding stones that simultaneously grind two surfaces of the supported workpiece, wherein an interval between the workpiece holder and each of the static pressure support members is not greater than 50 μm, and each of the static pressure support members support the workpiece holder based on the static pressure of the fluid that is not lower than 0.3 MPa.

2. The workpiece double-disc grinding apparatus according to claim 1, wherein the workpiece holder has a parallelism of 5 μm or below and a flatness of 5 μm or below.

3. The workpiece double-disc grinding apparatus according to claim 2, wherein at least a surface of the workpiece holder that is supported in the contactless manner is formed of alumina ceramics.

4. The workpiece double-disc grinding apparatus according to claim 3, wherein a surface of each of the static pressure support members that supports the workpiece holder in the contactless manner has a flatness of 20 μm or below.

5. The workpiece double-disc grinding apparatus according to claim 4, wherein each of the grinding stones is formed of diamond abrasive grains having an average grain size of 1 μm or below and a vitrified bond material.

6. The workpiece double-disc grinding apparatus according to claim 2, wherein a surface of each of the static pressure support members that supports the workpiece holder in the contactless manner has a flatness of 20 μm or below.

7. The workpiece double-disc grinding apparatus according to claim 1, wherein at least a surface of the workpiece holder that is supported in the contactless manner is formed of alumina ceramics.

8. The workpiece double-disc grinding apparatus according to claim 7, wherein a surface of each of the static pressure support members that supports the workpiece holder in the contactless manner has a flatness of 20 μm or below.

9. The workpiece double-disc grinding apparatus according to claim 1, wherein a surface of each of the static pressure support members that supports the workpiece holder in the contactless manner has a flatness of 20 μm or below.

10. The workpiece double-disc grinding apparatus according to claim 1, wherein each of the grinding stones is formed of diamond abrasive grains having an average grain size of 1 μm or below and a vitrified bond material.

11. A workpiece double-disc grinding method, the method comprising:

using a workpiece holder to support a thin-plate-like workpiece from an outer peripheral side along a radial direction and rotate the same;

supporting the workpiece holder from two opposing sides along an axial direction of rotation in a contactless manner by a static pressure of a fluid supplied by a pair of static pressure support members positioned on the two opposing sides of the workpiece holder; and simultaneously grinding two surfaces of the supported workpiece by a pair of grinding stones, wherein an interval between the workpiece holder and each of the static pressure support members is set to not greater than 50 μm and the static pressure of the fluid is set to not lower than 0.3 MPa to grind the two surfaces of the workpiece.

12. The workpiece double-disc grinding method according to claim 11, wherein the workpiece holder has a parallelism of 5 μm or below and a flatness of 5 μm or below.

13. The workpiece double-disc grinding method according to claim 12, wherein at least a surface of the workpiece holder that is supported in the contactless manner is formed of alumina ceramics.

14. The workpiece double-disc grinding method according to claim 13, wherein a surface of each of the static pressure support members that supports the workpiece holder in the contactless manner has a flatness of 20 μm or below.

15. The workpiece double-disc grinding method according to claim 14, wherein each of the grinding stones is formed of diamond abrasive grains having an average grain size of 1 μm or below and a vitrified bond material.

16. The workpiece double-disc grinding method according to claim 12, wherein a surface of each of the static pressure support members that supports the workpiece holder in the contactless manner has a flatness of 20 μm or below.

17. The workpiece double-disc grinding method according to claim 11, wherein at least a surface of the workpiece holder that is supported in the contactless manner is formed of alumina ceramics.

18. The workpiece double-disc grinding method according to claim 17, wherein a surface of each of the static pressure support members that supports the workpiece holder in the contactless manner has a flatness of 20 μm or below.

19. The workpiece double-disc grinding method according to claim 11, wherein a surface of each of the static pressure support members that supports the workpiece holder in the contactless manner has a flatness of 20 μm or below.

20. The workpiece double-disc grinding method according to claim 11, wherein each of the grinding stones is formed of diamond abrasive grains having an average grain size of 1 μm or below and a vitrified bond material.

* * * * *